US005269052A

United States Patent [19]

Tsuzuki

[11] Patent Number: 5,269,052

[45] Date of Patent: Dec. 14, 1993

[54] YARN CONDITIONING PROCESS

[75] Inventor: Kiyohiro Tsuzuki, Greenville, S.C.

[73] Assignee: TNS Mills, Inc., Greenville, S.C.

[21] Appl. No.: 974,232

[22] Filed: Nov. 10, 1992

[51] Int. Cl.[5] ..... B65H 54/00; F26B 5/04

[52] U.S. Cl. ..... 28/290; 28/285; 34/16

[58] Field of Search ..... 28/285, 286, 290; 68/8, 68/5 C; 8/155, 155.2; 34/15, 16, 92

[56] References Cited

U.S. PATENT DOCUMENTS 1,629,167 5/1927 Krantz ..... 28/285 X
2,127,638 8/1938 Brandwood ..... 34/16
4,590,683 5/1986 Magin ..... 34/15 X

FOREIGN PATENT DOCUMENTS 2550017 5/1977 Fed. Rep. of Germany ..... 28/285

*Primary Examiner*—Clifford D. Crowder
*Assistant Examiner*—John J. Calvert
*Attorney, Agent, or Firm*—Hardaway Law Firm

[57] ABSTRACT

A process for conditioning a yarn package enclosed within a conditioning chamber by introducing low temperature steam at approximately 140° F. for two seconds, thereby setting the twist of the yarn after spinning and winding.

3 Claims, 4 Drawing Sheets

YARN CONDITIONING PROCESS

BACKGROUND OF THE INVENTION

This invention is directed to a process for conditioning yarn which has been previously wound on a cone, cheese, or similar package.

PRIOR ART

The cotton yarn spinning process necessarily imparts a high degree of line twist and tension during spinning. This tension is increased by winding the yarn on the cone or similar core.

A variety of processes are known in the art for conditioning yarn to set the yarn twist. Chemical conditioning and bulk heat setting have been employed to condition yarn. Conditioning wool yarn with a combination of pressure and steam is also known in the art. However, such methods are often costly and inefficient in terms of processing times and energy requirements. Further, such processes are not suitable for all types of yarn. Therefore, there is much room for improvement within the art.

SUMMARY OF THE INVENTION

It is an object of the present invention to provide a process for conditioning cotton yarn which enables continuous production and processing of yarn packages.

It is a further object of this invention to provide a process for conditioning cotton yarn which is energy efficient.

It is a further and more particular object of this invention to provide a process for individually conditioning wound packages of yarn.

It is still a further and more particular object of this invention to provide a process of conditioning wound yarn which includes individual monitoring of the wound package of yarn.

These and other objects of the invention are provided by a process for conditioning a yarn package to set twists therein, comprising the steps of: providing a yarn package having an approximate weight of two to ten pounds; placing the yarn package within a conditioning chamber approximating the size of the yarn package; closing the conditioning chamber; evacuating the conditioning chamber; inserting into the conditioning chamber low temperature steam at a pressure of 1 $Kg/cm^2$, and causing a chamber pressure of 200 mm Hg at approximately 140° F. temperature for a two second period of time, thereby setting the yarn twist; restoring normal pressure, opening the chamber, and removing the yarn package thus treated.

DETAILED DESCRIPTION

In accordance with this invention, it has been found that an efficient process for conditioning cotton yarn can be provided which utilizes individual treatment of yarn packages. A typical yarn package is comprised of a central core upon which cotton yarn is wound. The core is typically cardboard but may be constructed of any material resistant to the heat, pressure, and temperature of the conditioning process. Such cores traditionally employ several shapes such as cones, cheeses, or cylinders.

Figure 1:
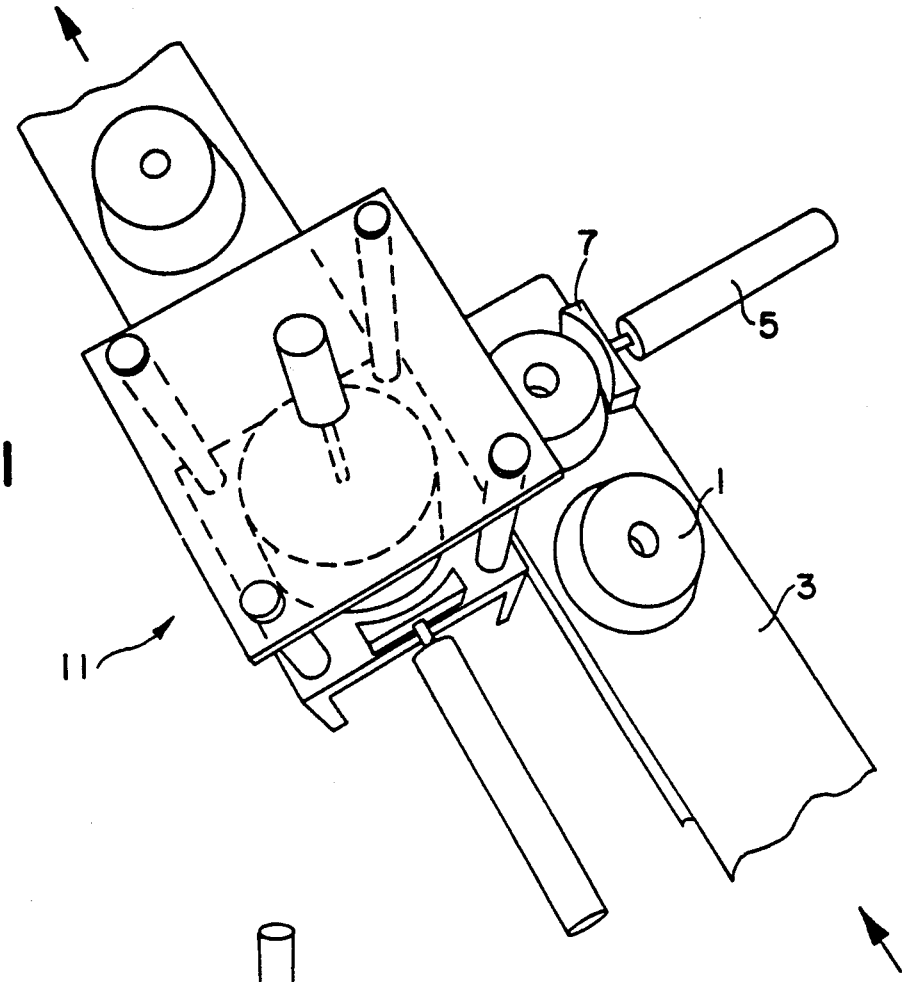
FIG. 1 of the drawings is an upper elevational view in partial section showing features of the claimed invention.
Figure 2:
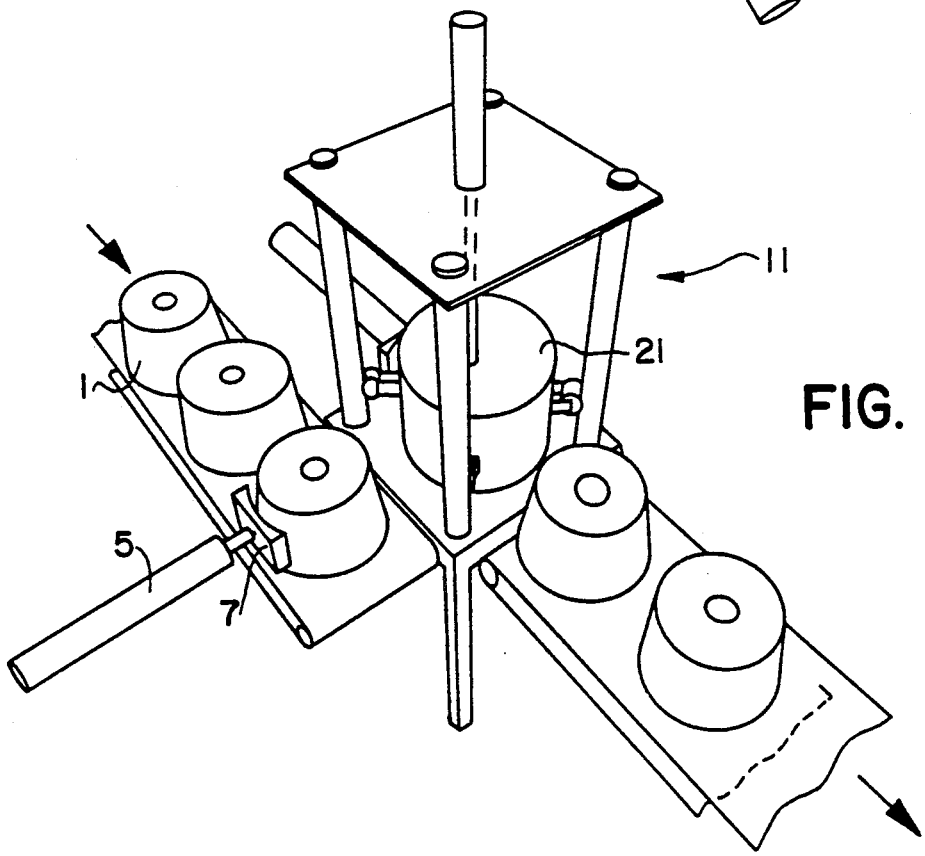
FIG. 2 of the drawings is a perspective view showing the relative movement of yarn through a conditioning apparatus.

It has been found that individual conditioning chambers can be used to accommodate individual yarn packages. As seen in FIGS. 1 through 5, a preferred embodiment of the conditioning process and apparatus is illustrated. As best seen in FIGS. 1 and 2, a yarn package 1 is supplied along a first conveyor 3 along the path indicated by the directional arrows. Near the terminus of conveyor 3, there is a first hydraulic piston 5 which controls the movement of an engaging arm 7.

Figure 3:
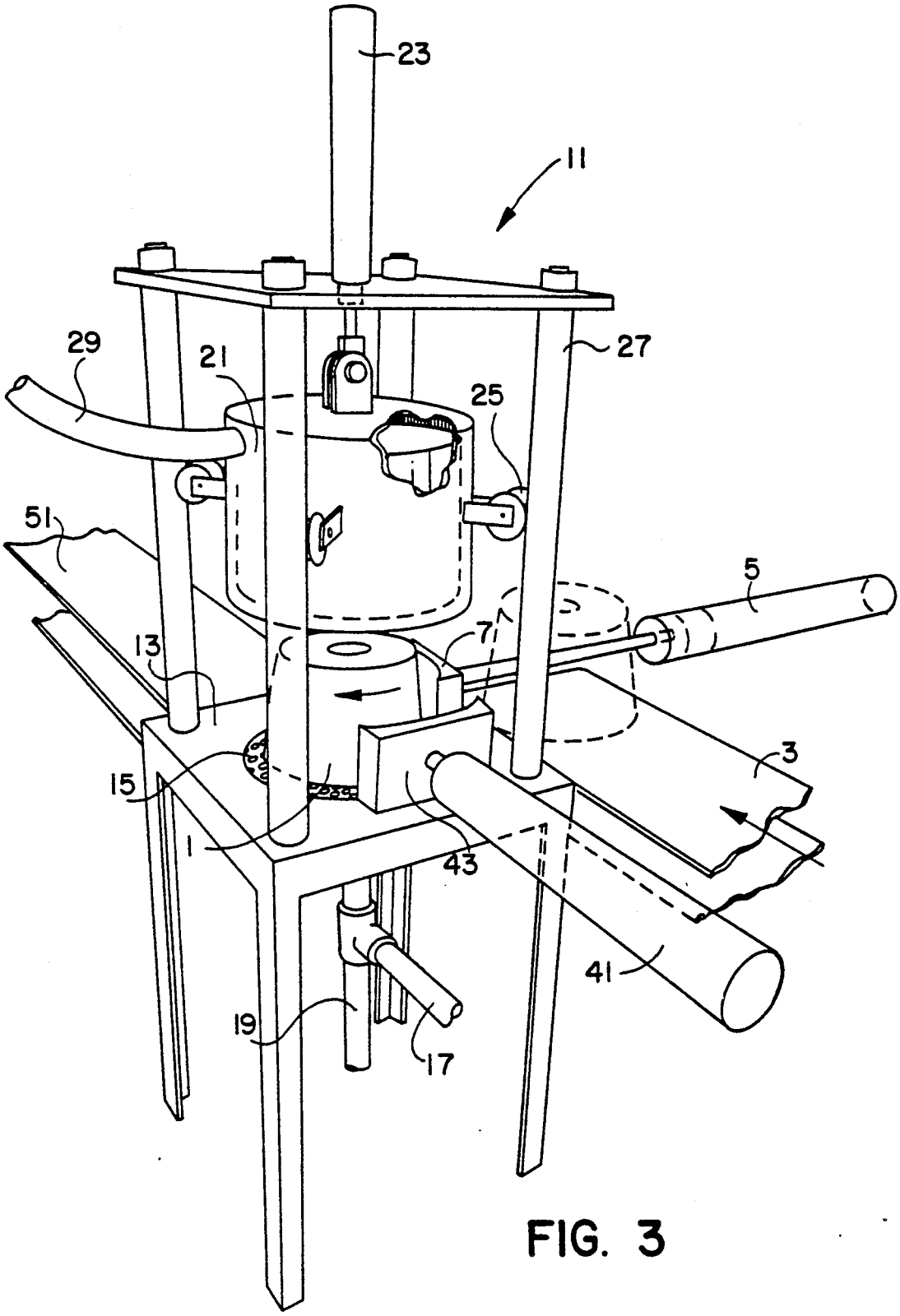
FIG. 3 of the drawings is a perspective view showing additional features of the invention.
Figure 4:
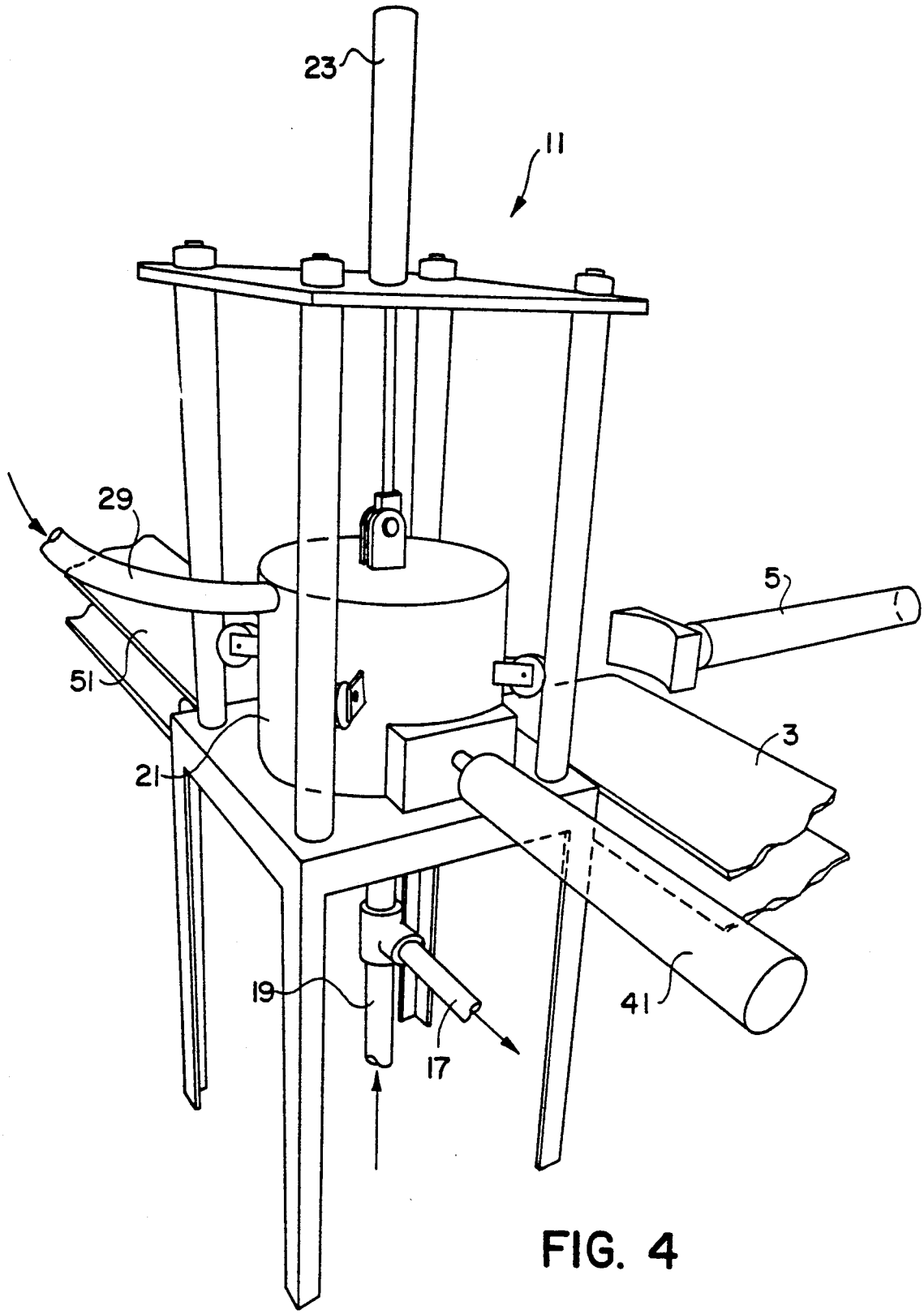
FIG. 4 of the drawings is a perspective view showing the conditioning chamber in an engaged position.
Figure 5:
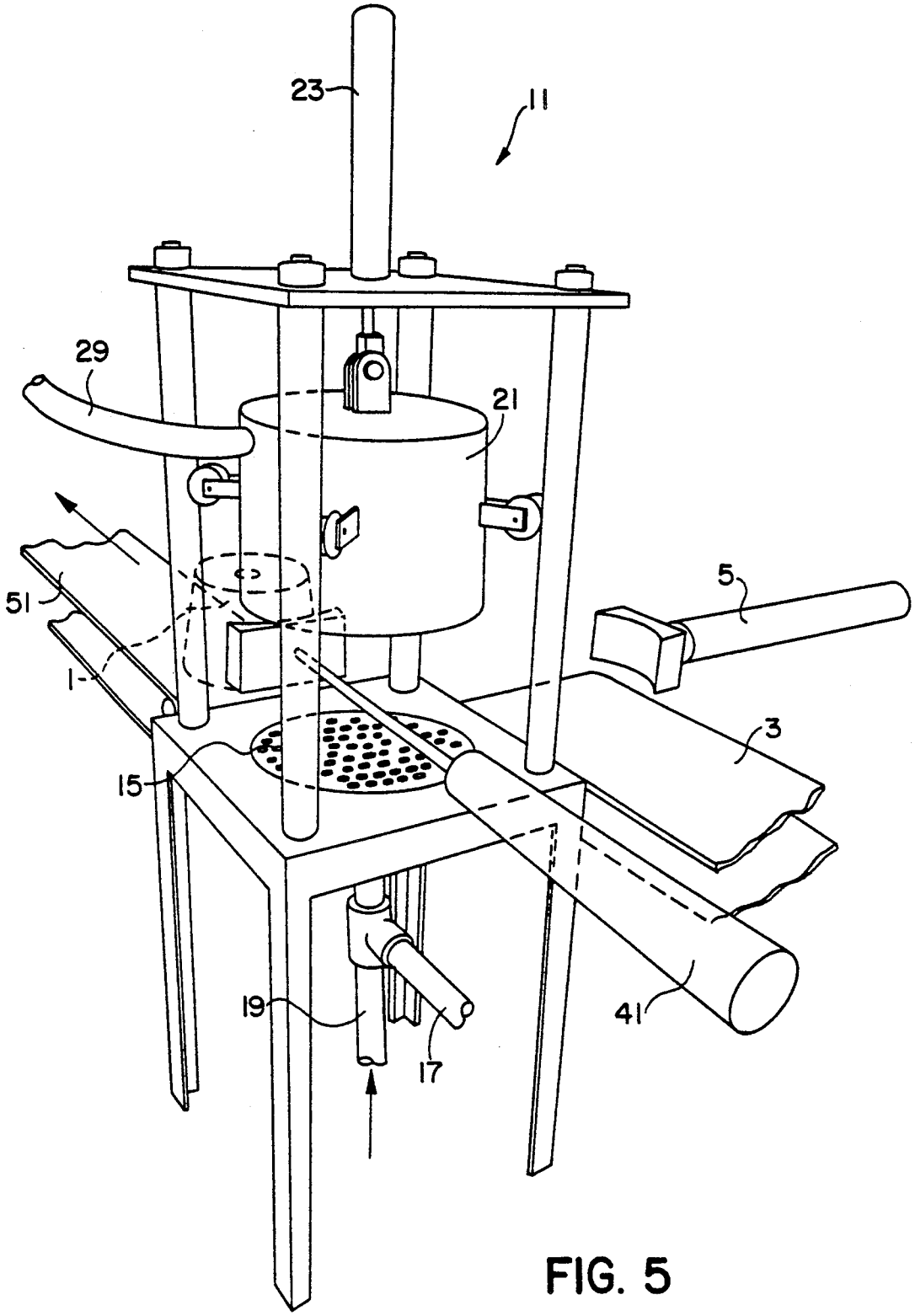
FIG. 5 is a perspective view similar to FIG. 4 in which the conditioning chamber is in an elevated position.

As best seen in FIG. 3, arm 7 is used to position package 1 from the terminus of conveyor 3 to an adjacent conditioning apparatus 11. Conditioning apparatus 11 is comprised of a steel platform 13, the center of which defines a plurality of openings 15. Openings 15 are in communication with a vacuum source via vacuum line 17 and are in further communication with a drainage line 19 through which liquids may be removed.

As arm 7 places yarn package 1 over openings 15, a double walled chamber 21 is lowered by a second hydraulic piston 23 such that yarn package 1 is now positioned within the interior of chamber 21. Guide means in the form of pulleys 25 cooperate with vertical support guides 27 to stabilize and direct the relative movement of chamber 21.

A line 29 for directing pressurized steam is provided which is in communication with the interior of chamber 21. A gasket is provided along the lower surface of chamber 21 to permit the selective formation of an air tight and pressure tight reversible seal with the upper surface of platform 13.

As chamber 21 is lowered onto platform 13, package 1 is thereby secured within the chamber. The gasket of chamber 21 is placed in firm contact with platform surface 13. A vacuum is then applied through vacuum line 17 which reduces the internal chamber pressure to approximately 60 mm Hg. The vacuum source is disconnected while simultaneously introducing into the chamber a supply of steam via steam line 29. The interior of chamber 21 is brought via 1 $Kg/cm^2$ steam to a pressure of 200 mm Hg with an internal air temperature of 140° F. This pressure and temperature combination is maintained for two seconds.

Following the combined pressure and temperature treatment, the supply of steam is discontinued. A separate port can then be used to restore normal pressure or, alternatively, vacuum line 17 can be used to restore normal pressure conditions to chamber 21.

If desired, ambient air can be passed through chamber 21 to cool the yarn package 1 as well as remove any excess moisture which may be present within the yarn. In addition, the temperature and/or moisture levels of the air flow can be monitored to insure that the yarn package 1 is sufficiently cool and dry for subsequent handling.

Following the optional cooling and drying step, chamber 21 is sufficiently raised to permit piston 41 and arm 43 to direct the now conditioned yarn package 1 to a second conveyor 51 for additional handling and packaging.

The optimal temperature for the conditioning interval is between 130°-140° F., the temperature being a correlative to the pressure of the supplied steam. Higher temperatures run a risk of damaging some yarns while lower temperatures are either less effective or require a longer exposure interval.

Further, the conditioning process uses low temperatures and reduced pressure which does not weaken or damage the cotton yarn. The conditioning process is safe for dyed yarn and does not shrink or otherwise alter the desired yarn characteristics. Further, the conditioning process does not disrupt the sequential assembly steps desired in supplying the finished yarn product. The yarn is wound, conditioned, and packaged in an incremental, individual fashion. Therefore, the conditioning process does not require removal of the yarn packages for bulk handling or conditioning. In addition, energy and time savings are realized in that the continuous flow of the assembly line is not interrupted. Individual conditioning of yarn packages in appropriately sized containers also lessens the energy cost of providing the low pressure and low temperature steam used in the conditioning process. Substantial time and energy savings are thus realized over other conditioning techniques which condition yarn supplies in bulk.

The above description is given in reference to a conditioning process for setting cotton yarn which has been wound onto packages. However, it is understood that many variations are apparent to one of skill in the art from a reading of the above specification and such variations are within the spirit and scope of the instant invention as defined by the following appended claims.

That which is claimed is:

1. A process for conditioning a yarn package to set the twist of the yarn therein after spinning and winding comprising the steps of:

providing a yarn package having an approximate weight of two to ten pounds;

placing said yarn package within a conditioning chamber approximately the size of said yarn package;

closing said conditioning chamber;

evacuating said conditioning chamber;

inserting into said conditioning chamber low temperature steam at an approximate pressure of 1 $Kg/cm^2$, and retaining an approximate pressure of 200 mm Hg at a temperature of 130° F. to 140° F. for a two second period of time, thereby setting the yarn;

restoring said conditioning chamber to ambient conditions, opening said chamber, and removing said yarn package thus treated.

2. The process according to claim 1 comprising the additional step of providing a flow of air through said conditioning chamber to facilitate the removal of excess moisture.

3. The process according to claim 1, wherein said low temperature steam is 140° F.

* * * * *